US006089791A

United States Patent [19]

Bernasconi

[11] Patent Number: 6,089,791

[45] Date of Patent: Jul. 18, 2000

[54] TUNNEL CONSTRUCTION METHOD

[76] Inventor: Riccardo Bernasconi, Rheinstrasse 5, CH-7320 Sargans, Switzerland

[21] Appl. No.: 09/145,389

[22] Filed: Sep. 1, 1998

[30] Foreign Application Priority Data

Sep. 2, 1997 [EP] European Pat. Off. ..... 97810624

[51] Int. Cl.[7] ..... E21D 9/00

[52] U.S. Cl. ..... 405/144; 405/138; 299/33

[58] Field of Search ..... 905/132, 138, 905/144, 146, 147, 150.1, 142; 299/11, 33

[56] References Cited

U.S. PATENT DOCUMENTS

| | | | |
|---|---|---|---|
| 360,959 | 4/1887 | Greathead | 405/144 |
| 3,260,054 | 7/1966 | Lorenz | 405/144 |
| 4,068,486 | 1/1978 | Uchida et al. | 405/144 |
| 4,729,693 | 3/1988 | Hentschel | 405/144 |
| 5,203,614 | 4/1993 | Robbins et al. | 405/144 |

FOREIGN PATENT DOCUMENTS

| | | | |
|---|---|---|---|
| 288707 | 11/1988 | European Pat. Off. | 405/144 |
| 0 580 510 A1 | 1/1994 | European Pat. Off. . | |
| 2 679 959 | 2/1993 | France . | |
| 87 157 | 4/1895 | Germany . | |
| 93 519 | 5/1896 | Germany . | |
| 2801616 | 7/1979 | Germany | 405/144 |
| 29 26 288 | 1/1981 | Germany . | |
| 269212 | 9/1992 | Japan | 405/144 |
| 8002451 | 4/1980 | Netherlands . | |
| 2236340 | 4/1991 | United Kingdom | 405/144 |
| 2 263 490 | 7/1993 | United Kingdom . | |
| WO 92/22732 | 12/1992 | WIPO . | |

OTHER PUBLICATIONS

Barbara Stack: "Handbook of Mining and Tunnelling Machinery", 1966, A Wiley—Interscience Publication, New York XP002053547, pp. 413–417.

Patent Abstracts of Japan, vol. 014, No. 231 (M–0974), May 16, 1990 and JP 02–058697 A (Komatsu Ltd), Feb. 27, 1990.—Abstract only —.

*Primary Examiner*—Eileen Dunn Lillis
*Assistant Examiner*—Frederick L. Lagman
*Attorney, Agent, or Firm*—Frishauf, Holtz, Goodman, Langer & Chick, P.C.

[57] ABSTRACT

To construct a tunnel in a formation (11, 15) with zones of high hydraulic pressure (15), a gallery (13) is driven from the stable formation (11) toward the problem formation zone (15). At least one lock zone (19) with pressure-tight gates (23, 23') is constructed under protection of the stable formation (11) at some distance from the problem formation zone (15). Behind this lock zone (19) the gallery (13) is now filled with water (25) and pressurized. Further driving into the problem formation zone (15) and therethrough is now performed under water (25) having a pressure corresponding to the hydraulic pressure of the problem formation zone (15). For this purpose the machines (47, 47', 73) are remote-controlled and are controlled and monitored from the atmospheric zone (17). Material transportation operations are managed substantially via the lock zone (19). The gallery (13) is stabilized against the static rock pressure by a first tunnel lining (71) and sealed against the hydrostatic pressure by a watertight internal ring installed inside the first tunnel lining.

14 Claims, 3 Drawing Sheets

TUNNEL CONSTRUCTION METHOD

BACKGROUND OF THE INVENTION

The present invention relates to a method for constructing a tunnel in a formation under hydraulic pressure, in which method an underground gallery is driven by mechanical rock excavation, the excavated rock is removed and the gallery is sealed against the hydraulic pressure.

Hydraulic pressures, especially high hydraulic pressures approaching about $130\times10^5$ Pa, as are expected to exist at the level of the planned Gotthard base tunnel in the Piora Syncline, for example, represent major problems for tunnel construction. This is further exacerbated when the formation, as in the cited example, is difficult to compact and has poor stability. Hydraulic pressure represents an enormous threat to miners, since in the worst case an inrush of water can very rapidly inundate the gallery. Lowering the hydraulic pressure to alleviate this danger may be extremely difficult, depending on the permeability of the problem formation zone, and it represents an enormous disturbance of the natural hydraulic equilibrium of the formation, with unforeseeable results.

SUMMARY OF THE INVENTION

One object of the invention is, therefore, to provide a tunnel construction method with which the danger to miners is minimized and the disturbance of the natural water balance of the formation is kept as small as possible.

According to one aspect of the invention, this and other objects can be achieved in that the excavation and removal of rock as well as the sealing of the gallery is performed under a back-pressure in the gallery that corresponds approximately to the hydraulic pressure of the formation. Thereby, the hydraulic pressure in the formation is left unaffected and also the water balance remains substantially unchanged. The danger of water inrush into the gallery is reduced and the scope of associated damage is kept within limits. Once the back-pressure has been built up in a fluid, especially water, largely filling the gallery, the danger of water inrush is completely prevented, since the hydraulic pressure is neutralized. Thus, in the heading phase, the gallery does not have to be sealed. Sealing of the gallery can be achieved from the heading gallery, thus ensuring favorable space conditions. Pressurization with a fluid is preferred over pneumatic pressure at increasingly high hydraulic formation pressures.

During the heading phase, it is sufficient in principle to ensure rock stabilization and to take measures to absorb the static rock pressure to be equalized. For this purpose there can be installed a first tunnel lining such as an external tubbing ring under high pressure conditions, in order continuously to safeguard the gallery-heading process.

Preferably, the gallery is sealed under high-pressure conditions. This is achieved expediently by an internal gallery ring dimensioned to match the hydrostatic pressure. This can be constructed, for example, of pumpcrete inside the first tunnel lining, which absorbs the static rock pressure.

Preferably, the back-pressure in the gallery is made higher than the hydraulic pressure in the problem formation, in order to prevent inflow of mountain water. This ensures that mountain water will not flush formation material into the gallery and that turbidities will be swept toward the gallery walls and therefore out of the field of view.

Preferably, the fluid filling the gallery will be circulated in order to clean it of turbidities. Expediently, the return flow of circulating fluid will be cleaned of turbidity-causing contaminants and the cleaned fluid pumped back to the gallery. The fluid will be cleaned in an atmospheric environment and the cleaned fluid pumped into the gallery by high-pressure pumps. Thereby the sludge formed can be disposed of under atmospheric conditions. Addition of chemicals such as flocculants to precipitate turbidities or sealants to seal the gallery can also take place under atmospheric conditions.

If necessary, supply and disposal activities for the working site in the high-pressure zone can be controlled from an atmospheric zone. Preferably, at least one lock secured by pressure-tight gates will be installed between the pressurized gallery and an atmospheric zone, in order to permit transportation of material from the atmospheric zone into the high-pressure zone and vice versa or to shorten the transportation route.

Preferably, control and monitoring of the construction tasks in the high-pressure zone take place from an atmospheric zone, and any work in the high-pressure zone is performed with remote-controlled apparatus and machinery in order to minimize risks for the miners.

Expediently, the lock (or locks) is (are) constructed in the gallery in the stable formation, the gallery stub on the far side of the lock is pressurized, and then the gallery is driven from the stable formation into the problem formation zone subject to hydraulic pressure. Thereby the preparations for gallery heading into the problem formation zone subject to hydraulic pressure are made under atmospheric conditions, protected by the stable formation, and the initial penetration of the problem formation zone is performed with a back-pressure already existing in the gallery.

Preferably, the excavated rock is crushed in the high-pressure zone and transported via pipelines to the atmospheric zone. Thereby the locks do not have to be operated for material removal, and the pressure gradient can be used to support delivery of the material to be removed.

Expediently, the first tunnel lining is constructed during heading work from lining segments assembled from a plurality of parts known as tubbing elements. This method has proved effective for constructing tunnel linings from prefabricated lining segments, which are transported from the rear through the constructed tunnel lining to the front end of the tunnel lining.

Preferably, a flocculant is added to the fluid in order to flocculate turbidities as rapidly as possibly and to achieve high transparency of the fluid. Thereby optical monitoring of the tasks is less hindered.

The fluid can be refrigerated and thereby frozen in a gallery segment, in order to cut off the pressurized gallery in the problem formation zone from the stabilized gallery zone, which is accessible under atmospheric conditions. Thereby the option exists to isolate the high-pressure zone with agents that do not necessitate mechanical operating capability of the gates. Consequently the gates can be overhauled or even reinstalled.

Preferably, the fluid from the lock is pumped or drained into a chamber of suitable size in order to evacuate the lock, and the fluid from the chamber is drained or pumped into the lock in order to fill the lock. Thereby there is no need on the one hand to remove the considerable volume of fluid when evacuating the lock, while on the other hand the lock does not have to be filled by high-pressure pumps during filling. Thereby fluid, time and energy can be saved.

DETAILED DESCRIPTION OF THE PREFERRED EMBODIMENTS

Figure 1:
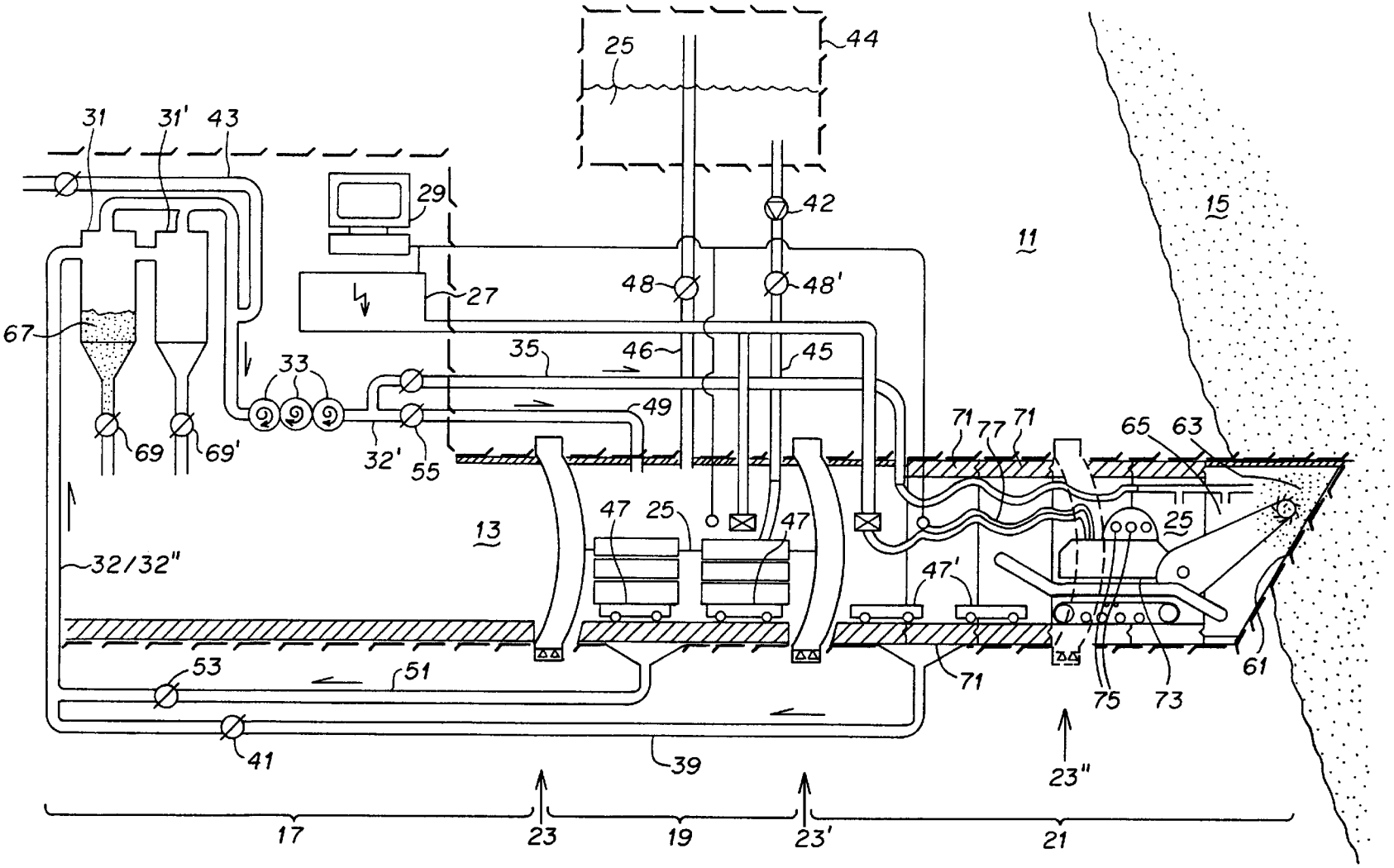
FIG. 1 shows a schematic diagram in vertical section of a tunnel.

FIG. 1 illustrates a tunnel segment in section. The numeral 11 denotes the stable formation, from which a gallery 13 is driven into the problem formation zone 15 subject to high hydraulic pressure. Gallery 13 has three zones: atmospheric zone 17, lock zone 19 and high-pressure zone 21. High-pressure zone 21 is partly in the stable formation 11 and partly in the problem formation zone 15, and becomes larger the further gallery 13 is driven. Between the individual zones 17, 19, 21 there are disposed pressure-tight armor-plate gates 23, 23'. Atmospheric zone 17 is accessible to miners. High-pressure zone 21, in contrast, is filled with water 25. Lock zone 19 is shown as half-filled with water 25 between gates 23 and 23'. Lock zone 19 can be filled with water 25 and pressurized, in order to allow it to be opened against high-pressure zone 21. Lock zone 19 can also be drained, however, and the pressure in lock zone 19 can be equalized in order to allow it to be opened against atmospheric zone 17.

The support equipment such as power supply 27, control and monitoring system 29 and cleaning tanks 31, 31' for the water 25 are kept in the atmospheric zone. They can therefore be operated at all times under normal mining conditions.

The water 25 is circulated in a loop 32. The water loop 32 can have a high-pressure zone 32' for the heading side of gallery 13 and lock zone 19, and a zone 32" with lower pressure in the atmospheric zone of gallery 13. The water pressure in the high-pressure zone is achieved by high-pressure pumps 33. These pump the water 25 via line 35 into the gallery zone 21 subject to hydraulic pressure. Via line 39, water 25 flows from high-pressure zone 21 back into atmospheric zone 17. The pressure is reduced as needed with a valve 41. This returning water 25 contains contaminants, which are cleaned in the settling or cleaning tanks 31, 31'. A fresh water feed line 43 is connected to loop 32 in order to make up any water loss. The fresh water is pumped into the loop with a pump, which is not shown.

To fill lock zone 19, water 25 is delivered with a pump 42 from a chamber 44, which stores the water 25 of lock zone 19, via line 45 in this zone. The air from lock zone 19 escapes via line 46 into chamber 44. Once lock zone 19 is full of water, valves 48, 48' are closed. Lock zone 19 is pressurized with high-pressure pumps 33 until its pressure corresponds to that in high-pressure zone 21. Then gate 23' between lock zone 19 and high-pressure zone 21 can be opened in order to shift material from lock zone 19 into high-pressure zone 21 or from high-pressure zone 21 into lock zone 19. For example, the mine car 47 loaded with tubbing elements in lock zone 19 can be exchanged for the empty mine car 47' in high-pressure zone 21.

By virtue of feed line 49 and return line 51, loop 32 is also closed in lock zone 19. Valve 53 reduces the water pressure of return line 51 to cleaning tanks 31, 31', and pumps 33 raise the pressure in the zone 32' of loop 32. The pressure can also be built up via a connection line (not shown), which can be closed with a valve, between high-pressure zone 21 and lock zone 19.

Lock zone 19 is evacuated by isolating it from loop 32 by closing valves 53 and 55. The pressure is then released by opening valve 53 for a short time. Once normal pressure has been established, valves 48, 48' to chamber 44 are opened. The water 25 is pumped into chamber 44 by pumps 42 and the displaced air flows from chamber 44 into lock zone 19. Gate 23 between atmospheric zone 17 and lock zone 19 can now be opened and an exchange of materials performed.

For safety, a gate 23" (shown as a broken line) is provided in high-pressure zone 21. Gate 23" is not used if gates 23, 23' both operate properly. However, if one of the gates 23, 23' fails, then gate 23" is used such that lock zone 19 can be relocated to between gates 23' and 23" or expanded to the zone between gates 23 and 23". For this purpose, however, the necessary connections for routing of the water 25 as well as for power supply and control must be provided in the corresponding zones, even though they are not illustrated in FIG. 1.

To reduce the pressure gradient to be absorbed by a gate 23, 23', 23", a series of locks can also be disposed one after the other. In such a series of locks, only the first lock zone 19 away from the atmospheric zone must be capable of being evacuated. Pressure equalization between the locks takes place via valves, with which water 25 is allowed to pass from the high-pressure side to the low-pressure side of a gate 23, 23', 23", and so on.

A slight overpressure relative to the hydraulic pressure in the problem formation zone 15 is maintained in high-pressure zone 21. Water 25 therefore penetrates continuously from high-pressure zone 21 into the problem formation zone 15, but is made up by a supply of fresh water to high-pressure zone 21 of gallery 13 from line 43 by means of high-pressure pumps 33. Because of the water loss at gallery face 61, a weak flow toward the problem rock 15 develops, thereby sweeping turbidities 63 which are unavoidably formed during excavation of rock 15 toward gallery face 61. Depending on the intensity of this flow, the water 25 in the gallery can thereby remain sufficiently clear to permit an adequate view of gallery face 61. Also depending on the circumstances, there develops a weak flow pressure, which acts favorably against collapses. However, a flow in loop 32 can additionally be brought about with high-pressure pumps 33 and valve 41. The fresh water is then delivered close to gallery face 61 of gallery 13, in order to provide the necessary field of view 65 with transparent, cleaned water 25 and to force the turbid water 25 out of the field of view 65. Turbid water 25 therefore flows to the return line 39 and is cleaned in cleaning tanks 31, 31'. The sludge 67 collected in cleaning tanks 31, 31' can be drained through valves 69, 69' and disposed of. By proper dimensioning of return line 39, it could be used as a pipeline to transport crushed rock along with sludge 67.

Heading of the tunnel, or in other words excavation of rock 11, 15 and installation of tunnel lining segments 71 can take place in proven manner. Nevertheless, submarine technology must be used in the design of the machines, so that they withstand the water pressure. In addition, the machines used in high-pressure zone 21, such as boring machine 73, conveyor units 47, 47', the stowing machine for tunnel lining and boring and grouting machines (not shown) must be remote-controlled, in order to avoid the need for human presence in high-pressure zone 21. Control of machines 73, 47, 47' is exercised from the atmospheric zone. Numerous operations can be performed by computer-controlled robots in machines 73, 47, 47', and merely have to be monitored with a control and monitoring system 29. Of course, machines 73, 47, 47' can also be selectively controlled and corrected from control and monitoring system 29. A good view of high-pressure zone 21 is of advantage for this purpose. Video cameras 75 on boring machine 73 record the surroundings. Their images are transmitted via circuit 77 to control and monitoring system 29. The information and control commands can also be transmitted by other means such as radio or other electromagnetic waves. To combat turbidity 63 in water 25, a flocculant is added thereto.

Monitoring of the processes in high-pressure zone 21 can also be achieved by techniques such as echo sounding or radar, in order to be able to work even in the presence of severe turbidities 63.

Figure 2:
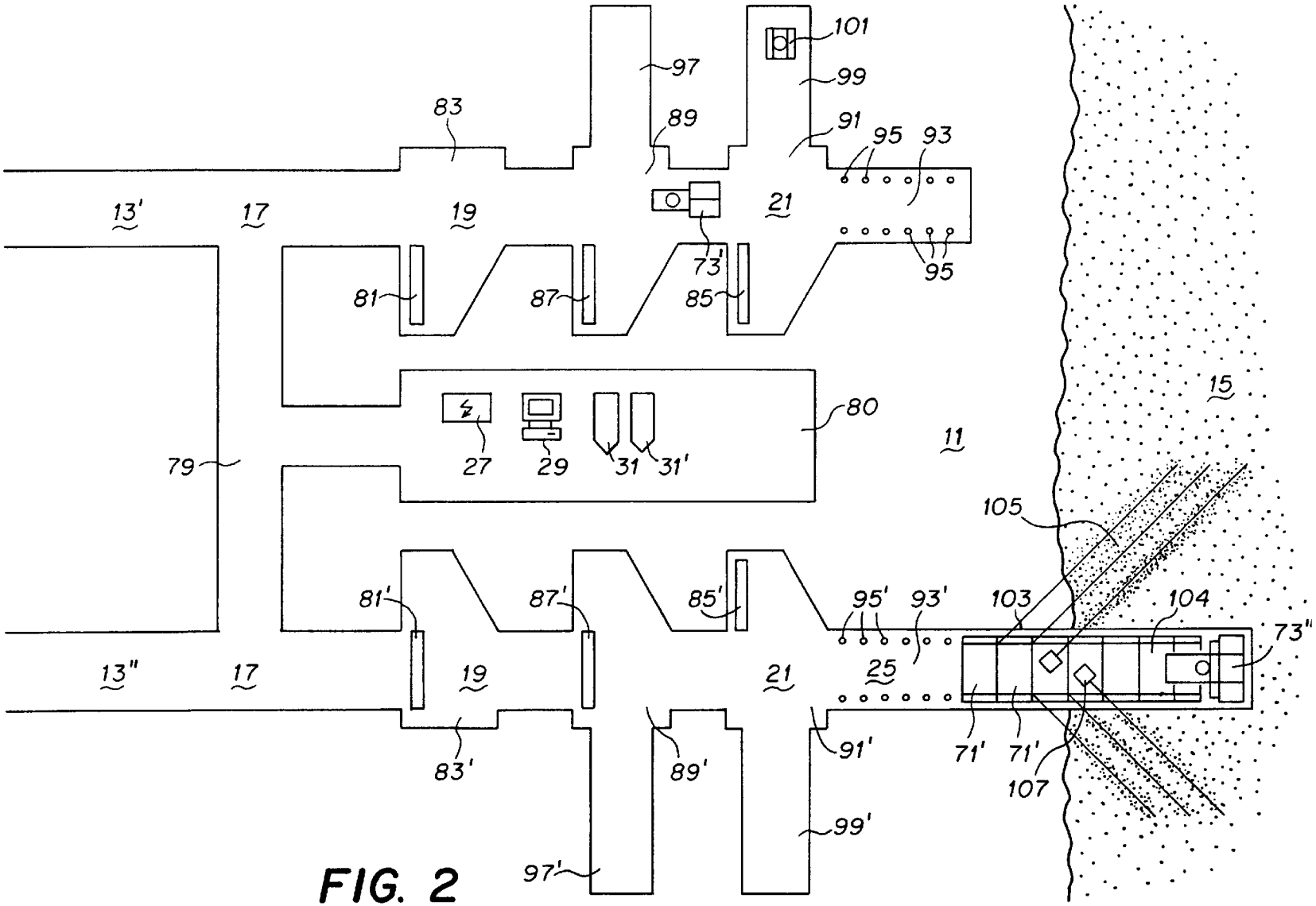
FIG. 2 shows a schematic diagram in a plan view of two parallel tunnels.

FIG. 2 shows a schematic plan view of a possible arrangement of two parallel galleries 13' and 13". Gallery 13' ends in the stable formation 11, while gallery 13" has been driven into the problem formation zone 15. Both galleries 13', 13" have an atmospheric zone 17, a lock zone 19 and a high-pressure zone 21, although high-pressure zone 21 of gallery 13' is not under pressure but instead is open to the atmospheric zone. The atmospheric zones 17 of the two galleries 13', 13" are joined by a connection gallery 79. A cavern 80 for technical support, disposed between the two galleries 13, 13", is linked to this connection gallery 79. In this cavern 80 there are installed, for example, the power supply 27, the control and monitoring system 29 for monitoring and control of the machines, the cleaning tanks 31, 31' and further human-operated devices to support the construction work in high-pressure zone 21 and transportation through lock zone 19.

In gallery 13', lock zone 19 can be isolated from atmospheric zone 17 with a sliding gate 81. Lock zone 19 can be sealed off from high-pressure zone 21 with a sliding gate 85.

Lock zone 19 can be divided into two locks 83 and 89 with a sliding gate 87. The second lock 89, provided with a side gallery 97, is made larger than lock 83, so that it can manage a larger transportation volume with one lock filling and offer adequate space for shunting maneuvers. Locks 83, 89 are at least long enough to accommodate the tunnel-boring machine 73' or the longest machine needed. A freezing zone 93 with refrigerating lines 95 is provided in heading gallery 91 of high-pressure zone 21. High-pressure zone 21 has a side gallery 99, to provide space for parking a salvage machine 101 for recovering a defective machine and/or for parking other machines.

Since gallery 13' is not driven into the problem formation zone, it is not yet under the influence of the high hydraulic pressure prevailing therein. The stable rock 11 protects gallery 13' from the hydraulic pressure. Gates 81, 85, 87 can therefore be left open as illustrated, and atmospheric conditions can prevail even in high-pressure zone 21.

The structure of gallery 13" is identical to that of gallery 13'. Two locks 83', 89' between atmospheric zone 17 and high-pressure zone 21 are formed with three gates 81', 87', 85'. The second lock 89' has a side gallery 97'. Heading gallery 91' is also provided with a side gallery 99'. In contrast to gallery 13', gallery 13" has been driven into problem formation zone 15. Therefore at least one of the gates 81', 87', 85' must be closed and high-pressure zone 21 must be filled with water 25. In the schematic diagram of FIG. 2, gates 81' and 87' upstream and downstream from lock 83' are closed. In this condition, lock 83' can be filled or evacuated. The water for filling lock 83 in gallery 13' is the same as the water for filling lock 83' in gallery 13", meaning that it fills either lock 83 or lock 83'. For lock 83 in gallery 13', the corresponding lock 83' in the neighboring gallery 13" performs the function of chamber 44 of FIG. 1 and vice versa. For this purpose they can be connected with each other by appropriate lines, which are not shown. Locks 89 and 89' can also be interconnected in order to ensure that air or water replacement can be achieved.

Gates 85 and 85' are not necessary for normal operation. On the one hand they are safeguards, and on the other hand they permit the construction of locks 83, 89; 83', 89' of different size. These size differences permit efficient operation of locks 83, 89, 83', 89', since usually only the smaller volume of locks 83, 83' has to be evacuated and filled, while the large locks 89, 89' have to be operated only in exceptions.

Refrigerating lines 95, 95' in freezing zones 93, 93' comprise a further safeguard. In critical situations, a further, nonmechanical closure of galleries 13', 13" is available by virtue of this arrangement. This closure of the gallery 13', 13" by freezing of the freezing zone 93, 93' permits repair of locks 83, 83', 89, 89' and of lock gates 81, 87, 85, 81', 87', 85' in the event, for example, that the lock zone 19 becomes buried.

Within the problem formation zone 15, heading gallery 91' is lined with prefabricated lining elements 71'. These are designed for the rock pressure and stabilize gallery 13" against cave-ins.

A reinforcing and sealing shell 105 is constructed if necessary around the tunnel lining 104 constructed from lining elements 71'. Because gallery 13" was constructed in well-defined size from the beginning on, much space is available for the boring and grouting work necessary for this purpose. The boring and grouting machine 107 can therefore operate at a large angle to the tunnel axis, thus shortening the necessary boring length.

Figure 3:
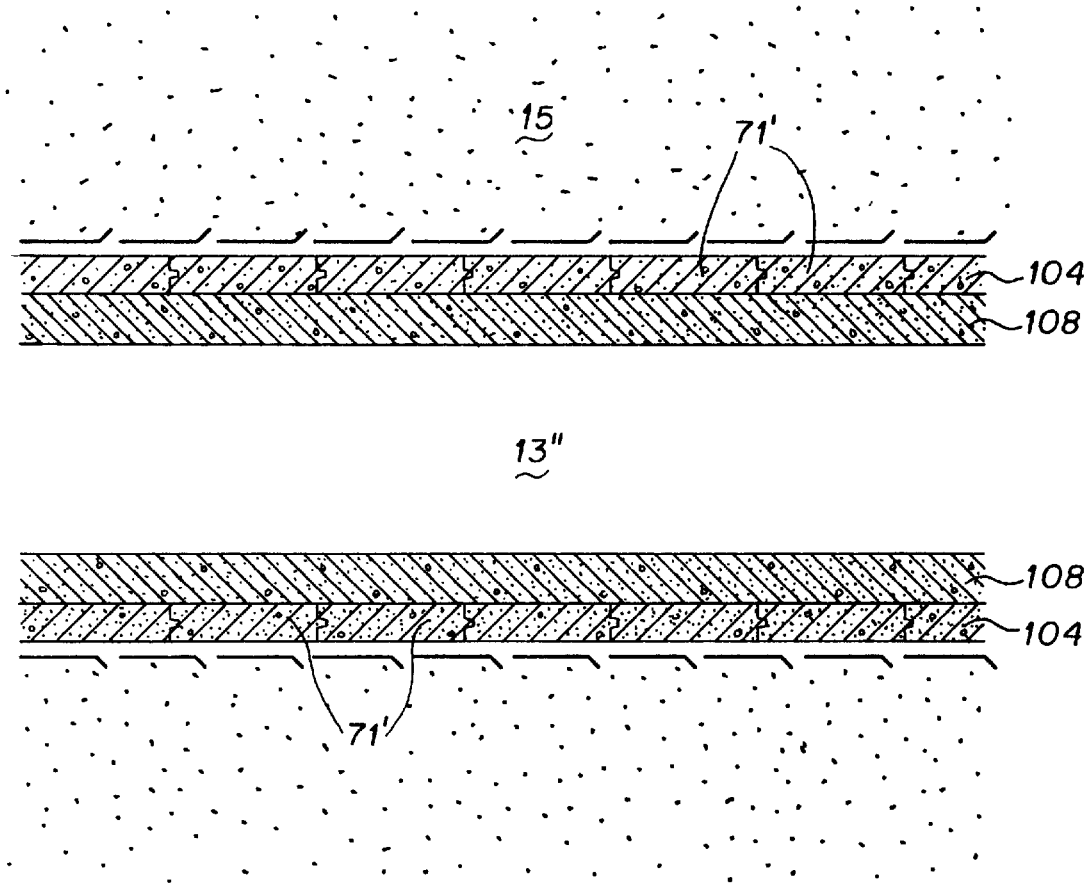
FIG. 3 is a cross section view through a finished tunnel lining.

FIG. 3 shows a section through the completed tunnel. The first tunnel lining 104 was assembled from tubbing rings 71' during the heading stage. It provides temporary bracing for the formation 15. Therein there was then installed, under high-pressure conditions, the internal ring 108 of pumpcrete, which withstands the hydraulic pressure even if the tunnel lining is open to the atmospheric zone. Sealing is provided, for example, with a sealing course between tubbing and internal ring.

After gallery 13" has penetrated and tunnel linings 104 and 108 have been completed, the machines are removed from tunnel lining 108 in problem formation zone 15, and the pressure in the tunnel is released at a slow, controlled rate. The tunnel lining 108 is monitored for changes. In the event of water inrush, the pressure can be immediately raised again, so that the damage can then be repaired and the leak reinforced and sealed under high-pressure pressure conditions. After successful release of the pressure in tunnel lining 108, the final support work can begin under atmospheric conditions.

I claim:

1. A method for constructing a tunnel in a formation under hydraulic pressure, comprising the steps of:

maintaining on a working site within a high-pressure zone a back-pressure corresponding approximately to the hydraulic pressure of the formation;

driving on said working site an underground gallery by mechanical rock excavation;

installing a first tunnel lining within said high-pressure zone;

sealing the gallery within said high-pressure zone against the hydraulic pressure of the formation; and removing the excavated rock from the high-pressure zone to an atmospheric zone.

2. A method according to claim 1, characterized in that the back-pressure is built up in a fluid, especially water (25), largely filling the gallery (13, 13', 13").

3. A method according to claim 2, characterized in that the fluid (25) is circulated in a loop (32) in order to clean it of turbidity-causing contaminants (63).

4. A method according to claim 3, characterized in that the fluid (25) is cleaned in an atmospheric environment (17) and the cleaned fluid (25) is pumped into the gallery (13) by high-pressure pumps (33).

5. A method according to claim 1, characterized in that the back-pressure in the gallery (13, 13', 13") is made higher than the hydraulic pressure in the formation (15).

6. A method according to claim 1, characterized in that the gallery (13, 13', 13") is sealed under high-pressure conditions.

7. A method according to claim 6, characterized in that the gallery (13, 13', 13") is sealed with an internal ring (108) dimensioned to match the hydrostatic pressure.

8. A method according to claim 1, characterized in that control and monitoring (29) of the construction tasks in the high-pressure zone (21) take place from the atmospheric zone (17), and any work in the high-pressure zone (21) is performed with remote-controlled apparatus and machinery (47, 47', 73, 73', 73", 101, 107).

9. A method according to claim 1, characterized in that the excavated rock (11, 15) is crushed in the high-pressure zone (21) and transported via pipelines to the atmospheric zone (17).

10. A method according to 1, characterized in that the first tunnel lining (104) is constructed from lining segments (71') assembled from a plurality of parts.

11. A method according to claim 1, characterized in that at least one of a flocculant and a sealant is added to the fluid (25).

12. A method for constructing a tunnel through a stable formation and a problem formation under hydraulic pressure, comprising the steps of:

maintaining on a working site within a high-pressure zone a back-pressure corresponding approximately to the hydraulic pressure of the formation;

driving on said working site an underground gallery by mechanical rock excavation;

sealing the gallery within said high-pressure zone against the hydraulic pressure of the formation; and removing the excavated rock from the high-pressure zone to an atmospheric zone;

wherein at least one lock secured by pressure tight gates is installed between the high-pressure zone and the atmospheric zone, in order to supply the working site from the atmospheric zone, wherein the at least one lock is constructed in the gallery in the stable formation; and pressurizing a gallery stub on a far side of the lock, and then performing the step of driving the gallery from the stable formation into the problem formation subject to hydraulic pressure.

13. A method according to 12, characterized in that the fluid (25) from the lock (26; 83; 89; 83'; 89') is pumped or drained into a chamber (44; 83'; 89'; 83; 89) of suitable size in order to evacuate the lock (26; 83; 89; 83'; 89'), and the fluid (25) from the chamber (44; 83'; 89'; 83; 89) is drained or pumped into the lock (26; 83; 89; 83'; 89') in order to fill the lock (26; 83; 89; 83'; 89').

14. A method for constructing a tunnel in a formation under hydraulic pressure, comprising the steps of:

maintaining on a working site within a high-pressure zone a back-pressure corresponding approximately to the hydraulic pressure of the formation, wherein said back pressure is built up in a fluid, especially water, largely filling the gallery;

driving on said working site an underground gallery by mechanical rock excavation;

sealing the gallery within said high-pressure zone against the hydraulic pressure of the formation; and removing the excavated rock from the high-pressure zone to an atmospheric zone; and refrigerating said fluid to freeze it in a gallery segment.

* * * * *